US006128563A

United States Patent [19]

Muraro

[11] Patent Number: 6,128,563

[45] Date of Patent: Oct. 3, 2000

[54] ELECTRONIC CONTROL DEVICE FOR MANAGEMENT OF THE STEERING IN EARTH-MOVING MACHINES

[75] Inventor: Umberto Muraro, Noventa Vicentina, Italy

[73] Assignee: FKI FAI Komatsu Industries S.p.A., Noventa Vicentina, Italy

[21] Appl. No.: 09/030,064

[22] Filed: Feb. 25, 1998

[30] Foreign Application Priority Data

Sep. 29, 1997 [IT] Italy ..... VR97A0090

[51] Int. Cl.[7] ..... G06F 7/70; G06F 19/00

[52] U.S. Cl. ..... 701/50; 701/1; 701/41; 172/4.5; 172/9; 706/904

[58] Field of Search ..... 701/1, 49, 50, 701/22, 29, 40, 41; 172/4.5, 9, 6; 340/425.5, 426; 706/904

[56] References Cited

U.S. PATENT DOCUMENTS 5,462,125 10/1995 Stratton et al. ..... 701/50
5,533,590 7/1996 Steffen et al. ..... 180/332
5,828,971 10/1998 Diekhans et al. ..... 701/50

FOREIGN PATENT DOCUMENTS 5-150828 6/1993 Japan ..... 701/50

*Primary Examiner*—William A. Cuchlinski, Jr.
*Assistant Examiner*—Gertrude Arthur
*Attorney, Agent, or Firm*—Browdy and Neimark P.L.L.C.

[57] ABSTRACT

An electronic control device for management of the steering in earth-moving machines, essentially comprises a programmable logic electronic control unit (1) which is arranged as an interface between a pushbutton console (2) for setting a steering mode and an input diagnostics system (3) associated with the functions of the gearcase and the engine and with positioning of the wheels of the machine. The setting of a steering mode on the pushbutton console (2) is made possible by simultaneous selection of at least two switches (50). The input diagnostics system (3) of the electronic control unit (1) comprises a front wheel alignment sensor (28) and a rear wheel alignment sensor (29) which are respectively positioned in the region of the front and rear axles of the earth-moving machine and are designed to detect respectively the alignment position of the front and rear wheels with respect to the longitudinal axis of the machine itself.

14 Claims, 1 Drawing Sheet

ELECTRONIC CONTROL DEVICE FOR MANAGEMENT OF THE STEERING IN EARTH-MOVING MACHINES

FIELD OF THE INVENTION

The present invention relates to an electronic control device for management of the steering in earth-moving machines.

REVIEW OF RELATED TECHNOLOGY

As is known, in the sector of earth-moving machines, for example excavators, a very important aspect is safety, in particular in connection with the maneuvering capabilities enabled by the various steering modes. In fact, in these machines it is generally possible to set three different steering modes, which can be selected depending on operational requirements and which are usually referred to by the terms: "crab steering" (parallel steering of the front and rear wheels), "circular steering" (steering of the front and rear wheels in opposite directions); and "front steering" (steering of the front wheels only).

The operator, who maneuvers the machine from a special driver's cab, obviously has the possibility of selecting both the most suitable gear and the type of preferred steering.

At the present time selection of the desired steering is performed in a fairly free manner and this involves, for example, the possibility of the operator being able to activate the crab steering mode or circular steering mode even when moving at speeds corresponding to the fastest gears, which, as is known, do not allow safe maneuverability of the machine.

Moreover, there are currently insufficient precautions against the danger of possible involuntary activation of a steering mode different from the one being used. This may obviously result in the execution of incorrect operational maneuvers which may be dangerous both for the personnel employed on the sites and for the operator himself who is driving the machine.

Since these situations must be avoided at all costs, the technical problem of the prior art is that of creating a device which is able to prevent, independently of human decisions or errors, the activation (involuntary or otherwise) of a steering mode which is unsuitable for the speed of the vehicle and/or its operating position.

OBJECTS AND SUMMARY OF THE INVENTION

The main object of the present invention is therefore that of solving the abovementioned technical problem by providing an electronic control device for management of the steering in earth-moving machines, in such a way that steering itself is guaranteed independently of any incorrect decisions or involuntary operations by the operators, on the basis of indications of objective technical parameters.

A further object of the present invention is that of providing an electronic control device which is constructionally simple and operationally entirely reliable.

These objects, along with others, are all achieved by the electronic control device for the steering in question, which comprises essentially a programmable electronic control unit which is arranged as an interface between a pushbutton console and an input diagnostics system associated with the gearcase, the engine and the positioning of the wheels.

In accordance with a further characteristic feature of the invention, the electronic control device comprises a front wheel alignment sensor and a rear wheel alignment sensor both designed to detect the alignment of the respective wheels with respect to the longitudinal axis of the machine.

The technical features of the invention, in accordance with the aforementioned objects, may be determined from the text below and the advantages thereof will emerge more clearly from the detailed description which follows, with reference to the accompanying drawing, which shows a purely exemplary and non-limiting example of embodiment thereof, illustrating schematically the control logic for management of the steering of earth-moving machines.

BRIEF DESCRIPTION OF THE DRAWINGS FIGURE

FIG. 1 is a schematic view of the invention.

DETAILED DESCRIPTION OF THE PREFERRED EMBODIMENT

Figure 1:
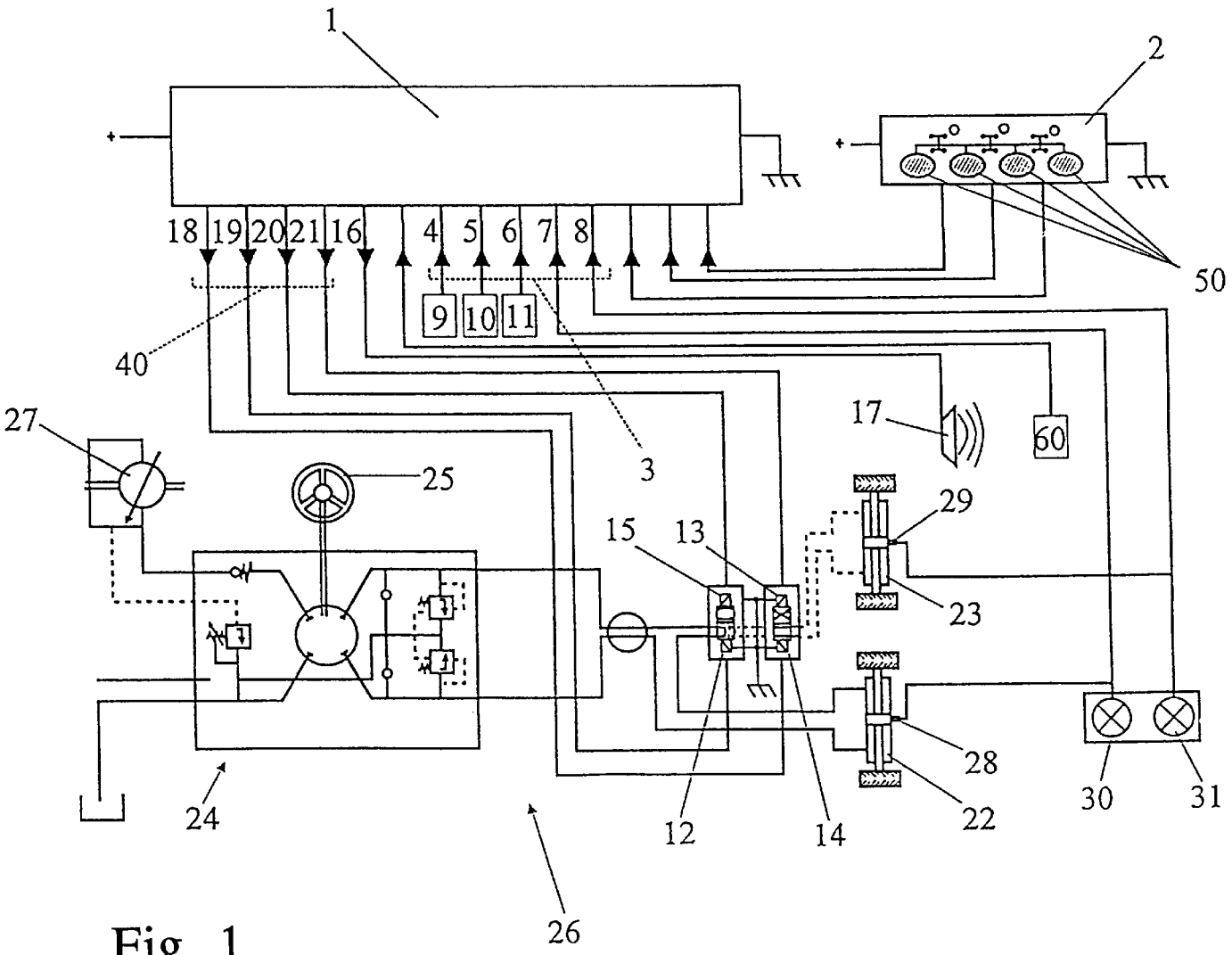

With reference to this FIG., 1 denotes a programmable logic electronic control unit which is connected, from a logic and circuitry point of view, to a pushbutton console 2 and is also associated, by means of an input diagnostics system 3, with the revs of the engine (signal 4), the gearcase functions (signal 5), the movement or otherwise of the machine (signal 6) and the alignment of the front wheels (signal 7) and rear wheels (signal 8) of the machine.

In particular, 9 and 10 denote means for detecting the revs of the engine and means for detecting the gear engaged.

11 denotes the means for detecting whether the machine is in a moving or static condition.

It is pointed out that the example in question comprises a gearcase with two gears, each of which has two speeds. It is assumed, namely, (as is frequently the case) that the earth-moving machine may overall be equipped with four gears, two of which are working gears and two travel gears.

The electronic control unit 1 outputs signals 40 which act on special solenoid valves 12–15 capable of enabling or disabling the steering mode set on the pushbutton console 2. An output 16 is also provided for an alarm signal. 17, the function of which will be explained in more detail below.

More precisely, in accordance with the accompanying figure, 18, 19, 20 and 21 denote, respectively, the output signals relating to circular steering, front steering, double steering, and crab steering, double steering being understood as referring to either circular steering or crab steering which involve steering both of the rear wheels and of the front wheels.

In the case of the example considered, use is made of a first solenoid valve 12, which actuates only front steering by means of a front jack 22, as well as two solenoid valves, a second one 14 and a third one 23, which actuate steering of the rear wheels by means of a rear jack 23 respectively in the crab and circular modes. These latter two solenoid valves 13 and 14 are actuated upstream by a double-steering solenoid valve 15 designed to allow the oil flow to be conveyed also to the rear axle of the machine. In this way, whenever double steering is selected, ie. crab steering or circular steering, first the abovementioned double solenoid valve 15 is excited, following which the corresponding chosen steering mode is activated.

Obviously a hydraulic steering system 24 is associated with a steering wheel 25 so as to allow the operator to perform steering of the wheels from a driver's cab (not shown).

In the accompanying figure, 26 denotes in its entirety the hydraulic circuit associated with the hydraulic steering system 24 and connected to a hydraulic pump 127, to the solenoid valves 12, 13, 14 and 15 and to the hydraulic jacks 22 and 23.

A front wheel alignment sensor 28 and a rear wheel alignment sensor 29 are positioned in the region of the front and rear axles of the machine, said sensors being connected in terms of circuitry to the electronic control unit 1 and being designed to detect respectively alignment of the front and rear wheels with respect to the longitudinal axis of the earth-moving machine.

Two indicators, a first one 30 and second one 31, designed to signal whether or not the front and rear wheels are aligned, are connected to the abovementioned sensors 28, 29 and mounted, within viewing range of the operator, in the control cabin.

The control unit 1 allows or prevents operation of the steering set on the pushbutton console by enabling specified solenoid valves 12, 13, 14, and 15 depending on both the logic housed inside it and on the signals received from the input diagnostics 3. This logic is subject to the operator's choices and to precise safety conditions.

The abovementioned logic has therefore been designed to prevent the possibility of performing dangerous maneuvers and therefore regards as authorized only some combinations of the three possible steering modes and the signals (4, 5, 6, 7, 8) received from the means 10 for detecting the gear engaged, means 9 for detecting the revs of the engine, means 11 for detecting the moving or static condition of the machine, and sensors 28, 29 for detecting whether the front and rear wheels are aligned or not.

Moreover, for safety reasons intended to ensure that the setting of a steering mode on the pushbutton console 2 is entirely voluntary, the said setting may be performed only by means of simultaneous operation of two switches. In the schematic representation of the pushbutton console 2 in the accompanying figure, there are in fact four pushbuttons 50 arranged parallel to one another, and only by pressing simultaneously two of them, in accordance with the diagram shown above the pushbutton console 2 itself, is it possible to set the desired steering mode. According to a particularly functional arrangement of the device in question, the electronic control unit 1 enables or disables operation of the various steering modes only in accordance with the procedures which are described below.

First of all, it regards as an authorized combination any steering mode selected on the pushbutton console 2 when the machine is at a standstill or is travelling in first or second gear.

Obviously when the front and/or rear wheels are not aligned, it is necessary to wait for this to happen in order for the selected steering mode to become operative. For this purpose the electronic control unit 1 stores the steering mode set on the pushbutton console 2 and renders it operative as soon as alignment of the front wheels and rear wheels is indicated to the operator by the two indicators 30, 31.

The electronic control unit 1 necessarily recognizes as an unauthorized combination the association of the circular steering mode with travel of the machine in fourth gear as well as association of the crab steering mode with travel of the machine in third or fourth gear. When these unauthorized combinations occur, the control unit 1 signals to the operator the selection of incorrect maneuvers by means of a first and a second alarm signal, which may be visual or acoustic, referred to above. In the example it has been assumed that these signals are provided by a single acoustic buzzer 17.

For safety reasons, when the abovementioned unauthorized combinations arise, the electronic control unit 1 causes obligatory changing-down from fourth to third gear when the circular steering mode is selected during travel of the machine in fourth gear, and gradual stoppage of the machine when the crab steering mode is selected during travel of the machine in third or fourth gear. Advantageously, a third—visual or acoustic—alarm signal is also provided, said signal being designed to indicate the loss of alignment of the rear wheels with respect to the longitudinal axis of the machine at the same time as operation of the front steering mode. In the example it has been assumed that this occurs by means of activation of the said acoustic buzzer 17 mentioned above.

It should be noted finally that, where realignment of the rear wheels is not possible owing to the occurrence of a fault of some kind, it is nevertheless possible to activate by means of a switch 60 the mode for manual steering of the rear wheels. This allows the rear wheels to be realigned manually with the aid of a visual check, after which, once the abovementioned manual steering of the rear wheels has been deselected, it is still possible to move the machine by travelling in the front steering mode alone.

What is claimed is:

1. An electronic control device for management of steering in an earth-moving machine having a gearcase, an engine, and positionable wheels; the control device comprising an electronic control unit (1) comprising programmable logic which is adapted to act as an interface between a pushbutton console (2) for selecting a set steering mode from a plurality of possible steering modes, and an input diagnostics system (3) associated with gear selection of the gearcase, with engine function, and with positioning of the wheels of the machine, said electronic control unit (1) allowing or preventing operation of the set steering mode which is activated by activation of corresponding solenoid valves (12, 13, 14, 15) as a function of the programmable logic and signals received from said input diagnostics system (3).

2. Device as claimed in claim 1, wherein setting of one of said steering modes on said pushbutton console (2) is performed by means of the simultaneous selection of at least two switches (50).

3. Device as claimed in claim 1, comprising at least one front wheel alignment sensor (28) and at least one rear wheel alignment sensor (29) respectively positioned in the region of the front and rear axles of the earth-moving machine and being designed to detect respectively at least one alignment position of the front and rear wheels with respect to the longitudinal axis of the machine itself.

4. Device as claimed in claim 3, comprising at least a first indicator (30) connected to said front wheel alignment sensor (28) and at least a second indicator (31) connected to said rear wheel alignment sensor (29) respectively designed to signal said front and rear wheel alignment positions.

5. Device as claimed in claim 1, wherein said earth-moving machine has four speed gears and said electronic control unit (1) regards as an authorized combination any steering mode selected on said pushbutton console (2) when said machine is travelling in first gear or second gear or is at a standstill.

6. Device as claimed in claim 1, wherein said earth-moving machine has four speed gears and said electronic control unit (1) necessarily recognizes as an unauthorized combination an association of a circular steering mode together with travel of the machine in fourth gear.

7. Device as claimed in claim 6, wherein said electronic control unit (1) causes change-down from fourth to third gear when the circular steering mode is selected during travel of the machine in fourth gear.

8. Device as claimed in claim 6, wherein said electronic control unit (1) activates a first alarm signal (17) indicating an incorrect maneuver in the presence of said unauthorized combination of the circular steering mode together with travel of the machine in fourth gear.

9. Device as claimed in claim 1, wherein said earth-moving machine has four speed gears and said electronic control unit (1) necessarily recognizes as an unauthorized combination an association of a crab steering mode together with travel of the machine in third or fourth gear.

10. Device as claimed in claim 9, wherein said electronic control unit (1) causes gradual stoppage of the machine when a crab steering mode is selected during travel of the machine in third or fourth gear.

11. Device as claimed in claim 9, wherein said electronic control unit (1) activates a second alarm signal (17) indicating an incorrect maneuver in the presence of said unauthorized combination of the crab steering mode together with travel of the machine in third or fourth gear.

12. Device as claimed in claim 1, wherein said electronic control unit (1) stores the steering mode set on said push-button console (2) so as to render it operative once alignment of the front wheels and rear wheels has been achieved.

13. Device as claimed in claim 1, comprising a switch (60) for activating a mode for manual steering of the rear wheels, designed to allow steering of the rear wheels alone, making alignment thereof possible by means of a visual check by the operator.

14. Device as claimed in claim 1, wherein said electronic control unit (1) activates a third alarm signal (17) where there is loss of alignment of the rear wheels with respect to the longitudinal axis of the earth-moving machine when said front steering mode is operationally active.

* * * * *